US007472434B1

(12) United States Patent
Moldthan et al.

(10) Patent No.: US 7,472,434 B1
(45) Date of Patent: Jan. 6, 2009

(54) CONCEALED WIDESPREAD FAUCET AND METHOD OF INSTALLING SAME

(75) Inventors: Jason R. Moldthan, Greer, SC (US); Jeffrey H. Baldwin, Easley, SC (US); Bryan Bennett, Travelers Rest, SC (US)

(73) Assignee: T&S Brass and Bronze Works, Inc., Travelers Rest, SC (US)

( * ) Notice: Subject to any disclaimer, the term of this patent is extended or adjusted under 35 U.S.C. 154(b) by 0 days.

(21) Appl. No.: 12/052,249

(22) Filed: Mar. 20, 2008

(51) Int. Cl.
*E03C 1/04* (2006.01)

(52) U.S. Cl. ..... 4/678; 4/676; 137/801

(58) Field of Classification Search ..... 4/675–678; 137/801

See application file for complete search history.

(56) References Cited

U.S. PATENT DOCUMENTS 6,273,138 B1 * 8/2001 Yoney ..... 4/678
6,345,643 B1 * 2/2002 Ko ..... 4/678

OTHER PUBLICATIONS

The Standard Collection by American Standard, Model 0283 Series, Pedestal Lavatory Installation Instructions, American Standard, Inc., 2002.
Chicago Faucets, Kitchen Sink Faucets, 1201-ACP, The Chicago Faucet Company, 2006.
Chicago Faucets, Installation Instructions for Widespread-Concealed Faucets, 39 pages, Sep. 1999.
Danze, Specifications, Two Handle Mini-Widespread Lavatory Faucet, Danze, Inc., Two-Handle lavatory Faucet Installation Procedures, Jan. 7, 2001.
Delta Models 2255, 2256 Series—Two Handle Widespread Victorian Kitchen Faucets, 2003.
Elkay Specifications Commercial Faucet Model LK800AT08L2, Elkay, 2005.
Fisher Widespread Deck Faucet, Fisher Manufacturing Company, 2006.
Kohler Installation Guide Kitchen Sink Faucet, Kohler Co., 2006, Faucets Kitchen Sink Faucet Features.
Moen Two-Handle Lavatory Faucet, Moen, Inc., 2005.
T&S Installation and Maintenance Instructions Concealed Body—Widespread Lavatory Faucets, T&S Brass and Bronze Works, Inc., 2004.
Meiya Double Handle Mixer, Wenzhou Meiya Sanitary Wares Co., Ltd, 2005.
Zurn Aquaspec Faucets Model—Z83100 Series Flex Mount Widespread, Zurn Industries, Inc. Oct. 12, 2005.
Zurn Widespread Engineering specifications Zurn AquaSpec© 1831A1, Zurn Industries, Inc., 2006.

* cited by examiner

*Primary Examiner*—Tuan N Nguyen
(74) *Attorney, Agent, or Firm*—Dority & Manning, P.A.

(57) ABSTRACT

A wide spread faucet includes a main body, which is formed as a unitary forging. The valves are factory installed in the valve housings, which are pre-connected to the main body at the factory. A hanger holds the main body in place to the sink deck while the installer inserts the C-washers to hold the valve housings above the sink deck and the main body below the sink deck. The hanger is disengaged from the sink deck and the main body. The C-washers enable the installer to automatically level the faucet and tighten the threaded flange nuts beneath the sink deck to secure the valve housings to the sink deck in the leveled condition. The center shank is connected at the factory to a deck flange nut. The center shank is compression fitted to the main body and secured to the sink deck by a central flange nut beneath the sink deck and the deck flange nut above the sink deck.

20 Claims, 10 Drawing Sheets

10
18a
18b
18c
19a
19b
20a
20b
17a
17f
17b
30c
30b
30
30a
17c
17d
23
23c
23b
14c
27c
14d
14a
27a
14b
14e
27d
27
16c
14f
16c
14g
27b
24
24b
12g
12a
16a
24a
16b
12e
12f
15b
15a
21c
21
21b
21a
15c
22
15c
15d
11m
11l
11n
11
11i
11h
28a
28b
11a
13f
11c
11g
11d
11b
13a
13b
13e
40b
40
13c
13d
40a

CONCEALED WIDESPREAD FAUCET AND METHOD OF INSTALLING SAME

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

The time to install a conventional concealed, wide spread faucet is about 15 minutes for an expert plumber and about 30 to 45 minutes for an unskilled helper. When a conventional concealed, wide spread faucet is unpacked from the shipping carton, before the plumber can begin to install the faucet in the sink, the plumber first must uninstall the valve cartridges and all above deck nuts, washers, etc., which are generally on the faucet in the condition in which it is received from the factory. Thus, during the installation, the plumber must re-install the valve cartridges, and upon doing so the installer could reverse the hot and cold valves, cause a leak path during re-installation of the valve cartridges and/or damage the valve cartridges.

Other similar concealed, wide spread faucets require nuts on the top and bottom side to be tightened the correct number of turns to ensure that the faucet is installed in a level condition. This circumstance presents a current burden that plumbers would like to avoid. Plumbing companies usually hire unskilled helpers to install faucets. However, if the faucet is not installed in a level condition, then the plumber that detects the non-level installation must take corrective measures. Such measures require the plumber to take apart about half of the faucet, including unscrewing the top and bottom nuts, which requires the plumber to shift positions from above the sink to beneath the sink numerous times before the top and bottom nuts can be removed, and repeating the process after the faucet is leveled and the top and bottom nuts must be reconnected.

Still other similar concealed, wide spread faucets require the installer to connect conduits leading from each of the valves to the spigot that is disposed between the valve housings.

Conventional wide spread faucets provide control over the volume of flow per unit of time by including a flow control device installed in either the gooseneck or in the valve cartridges. In this way, the flow out of the gooseneck can be limited to two gallons per minute, four gallons per minute or whatever flow is desired. However, providing flow control in either of these ways presents its own set of disadvantages. Once installed, the gooseneck and the cartridges are easily accessible and subject to vandalism that affects the flow control device as well. Even in the absence of vandalism, over time the gooseneck and the cartridges are likely to be damaged and need replacing, and such damage likely will require incurring the additional expense of replacing the flow control device. Upon replacing a gooseneck with built-in flow control device, the user might not realize that the replacement gooseneck must be the type with built-in flow control device until after the user has installed a gooseneck without a built-in flow control device. Or the new gooseneck might have a built-in flow control device with a different flow rating that is unsuitable for the end use.

Another disadvantage of providing the cartridge with a built-in flow control device is the inability to control the overall flow out of the gooseneck. For instance, if the flow needs to be two gallons per minute and each cartridge is provided with a built-in flow control device rated at one gallon per minute, then the overall flow only becomes the desired two gallons per minute when both cartridges are open. When only one cartridge is open (hot or cold), then the overall flow out of the gooseneck is only one gallon per minute. Similarly, if each cartridge is provided with a built-in flow control device rated at two gallons per minute, the overall flow out of the gooseneck becomes the desired two gallons per minute when cartridge is open, but up to four gallons per minute as the other cartridge is opened.

OBJECTS AND SUMMARY OF THE INVENTION

It is a principal object of the invention to provide a concealed, wide spread faucet having a one piece main body.

It is another principal object of the invention to provide a concealed, wide spread faucet can be installed in a sink without having to remove and re-install the valve cartridges, which are installed at the factory and leak tested at the factory to ensure properly functioning valve cartridges.

It is an additional principal object of the invention to provide a concealed, wide spread faucet to reduce the number of components required for installation of the faucet.

It is a further principal object of the invention to provide a concealed, wide spread faucet that is configured so as to self-level the faucet to the sink. Having the self level feature will help the installer do the installation correctly and relieve the plumber from having to redo the installation.

It is still an additional principal object of the invention to provide a method of installing a concealed, wide spread faucet wherein a hanger attached at the bottom of the main body would stick up through the center hole in the sink and hold the body with the valve housing extending sufficiently through their holes in the sink while a C-washer was being positioned to hold each the valve housing.

It is a still another principal object of the invention to provide a concealed, wide spread faucet that is configured with features so that installation is almost fool proof so that relatively unskilled labor can install faucets correctly and relieve more highly skilled labor from having to redo the installation.

It is a yet further principal object of the invention to provide a concealed, wide spread faucet that is configured with features so that installation can be completed by unskilled labor in about three minutes or less.

It is yet an additional principal object of the invention to provide a concealed, wide spread faucet that provides flow control without suffering the disadvantages noted above.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a concealed, wide spread faucet for installation in a sink comprises a main body, which desirably is formed as a unitary forging. The valve seats and valves desirably are factory installed in the valve housings, which desirably are permanently pre-connected to the main body at the factory. Only the center shank remains to be connected to the central receptacle of the main body by the installer using a compression nut during the installation. The central receptacle is configured to carry the compression nut, which is configured to receive thereon and carry a central flange nut that is used to secure the center shank to the sink deck.

A hanger is provided to hold the main body in place to the sink deck with the compression nut carrying the central flange nut and aligned in position to receive the center shank and guide the center shank into the central receptacle of the main body. Configured to engage each of the valve housings of the main body, a C-washer is provided to be inserted by the installer between the respective valve housing and the upper surface of the sink deck to hold the valve housings above the sink deck and the main body below the sink deck while automatically leveling the faucet with respect to the sink deck. The hanger can be disengaged from the sink deck and the main body because the C-washers enable the installer to tighten the threaded flange nuts beneath the sink deck to secure the valve housings to the sink deck. The center shank is connected at the factory to a deck flange nut, and the resulting structure can be inserted into the main body from above the sink deck with the deck flange nut resting against the upper surface of the sink deck. The center shank can be secured to the sink deck by the central flange nut carried on the compression nut beneath the sink deck and the deck flange nut above the sink deck. The compression nut can engage the main body so as to compression fit the center shank to the main body in a watertight seal.

A method of installing in the deck of a sink, the concealed, widespread faucet in accordance with an embodiment of the present invention now will be described. It is assumed that the deck of the sink has been prepared with three properly spaced and sized openings, including a central opening flanked on each side by an outlying opening. The widespread faucet is provided to the installer in the fully assembled condition except for the center shank and the deck flange, which is connected to the center shank at the factory.

The installer begins by hooking the hanger to the main body with the compression nut loosely connected to the main body and the central flange nut carried on the top of the compression nut. The installer moves beneath the sink deck the hanger and main body carrying the compression nut and the central flange nut. From beneath the sink deck, the installer pushes the hanger through the center hole in the sink deck to hang the main body from the sink deck with the two valve housings projecting through the two outlying holes in the sink deck.

From above the sink deck, the installer inserts the C-washers to hold the valve housings in place above the sink deck and thereby levels the faucet assembly. The installer disengages the hanger and pushes it beneath the sink deck. From above the sink deck, the installer inserts the center shank through the middle hole in the sink deck and into the central receptacle of the main body so that the skirt of the deck flange rests atop the sink deck.

From beneath the sink deck, the installer tightens the two flange nuts to secure the two valve housings to the sink deck and tightens the center flange nut to secure the center shank to the sink deck. From beneath the sink deck, the installer tightens the compression nut to secure the center shank to the main body. Since the compression nut is adjustable, it should be the last nut to be tightened in order to ensure that all of the other connections are rigid. From beneath the sink deck, the installer makes the appropriate connections to attach the water supply lines to the faucet.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention.

DETAILED DESCRIPTION OF PRESENTLY PREFERRED EMBODIMENTS

Reference now will be made in detail to the presently preferred embodiments of the invention, one or more examples of which are illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
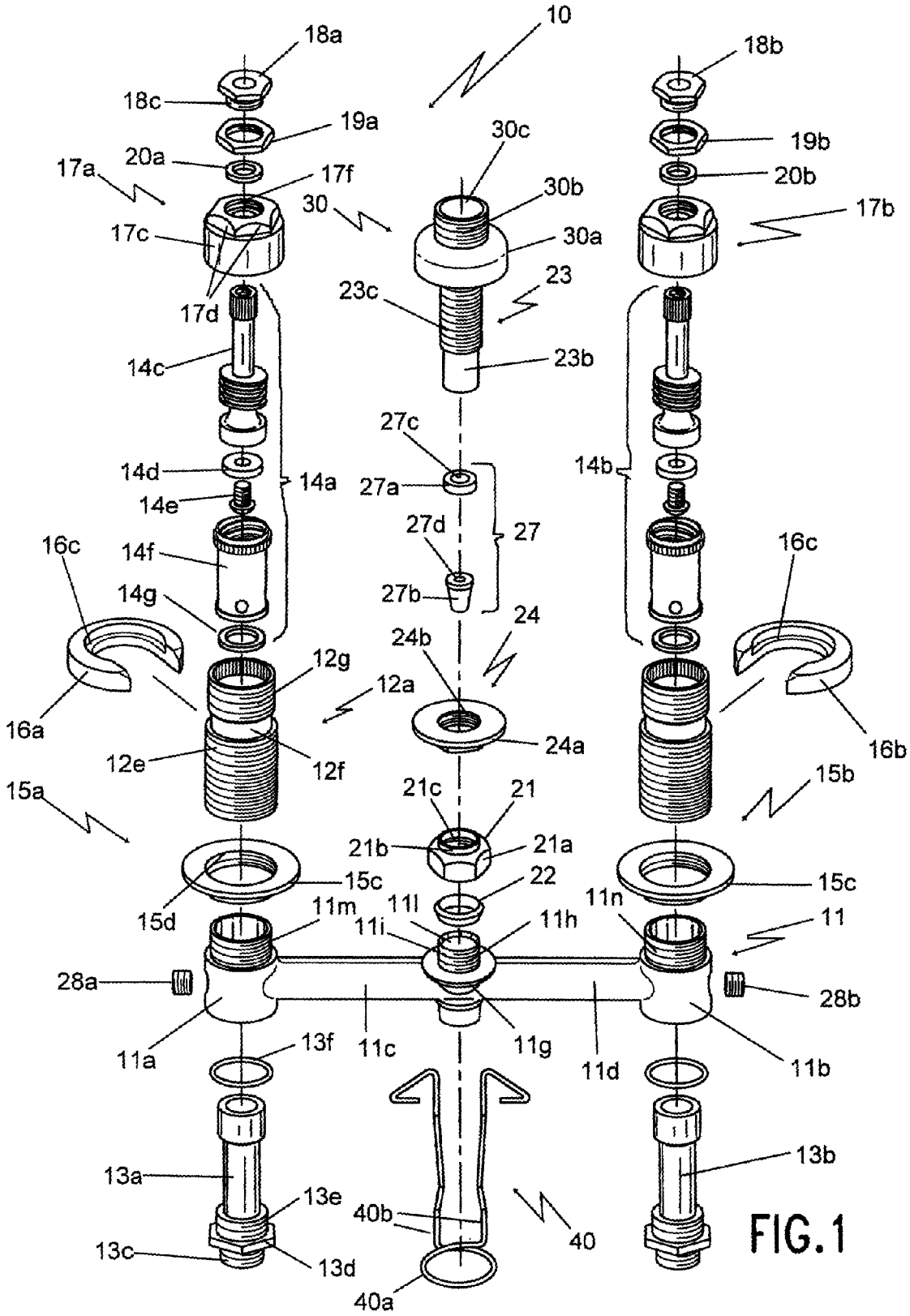
FIG. 1 is an elevated perspective, assembly view of an embodiment of the faucet assembly of the present invention.

A presently preferred embodiment of the concealed, wide spread faucet is shown in FIG. 1 in an elevated unassembled perspective view and is indicated generally by the numeral 10.

Figure 5:
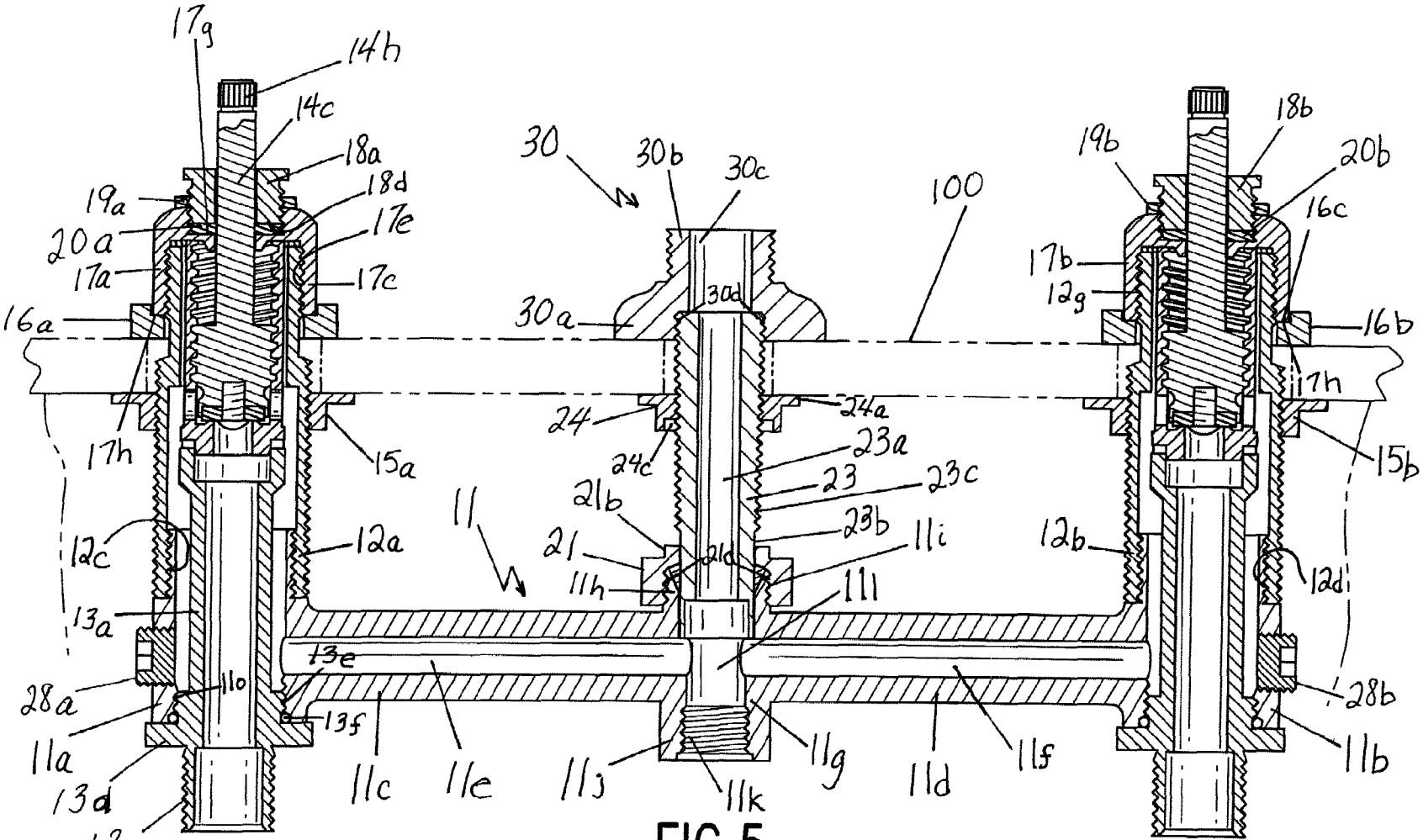
FIG. 5 is a cross-sectional view of the embodiment shown in FIG. 2 taken in the direction in which the arrows designated 5-5 in FIG. 2 are pointing.

As shown in FIG. 1, the wide spread faucet 10 desirably includes a main body 11 that is formed as a unitary structure and includes on one end thereof a first housing 11*a* and on the other end thereof a second housing 11*b*. The main body 11 includes a first branch 11*c* connected at one end thereof to the first housing 11*a*. A second branch 11*d* is connected at one end thereof to the second housing 11*b*. As shown in FIG. 5, each of the first branch 11*c* and the second branch 11*d* defines a respective hollow passage 11*e*, 11*f* internally thereof and communicating with, respectively, first housing 11*a* and second housing 11*b*.

As shown in FIG. 1, the main body 10 further defines a central receptacle 11*g* disposed between the first housing 11*a* and the second housing 11*b*. As shown in FIG. 5, the central receptacle 11*g* is connected to the other end of first branch 11*c* and to the other end of second branch 11*d*. As shown schematically in FIG. 5 for example, in this configuration, the first housing 11*a* is disposed in fluid communication with the second housing 11*b* via the first passage 11*e*, the central receptacle 11*g* and the second passage 11*f*. In the embodiment shown, the central receptacle 11*g* is disposed midway between the first housing 11*a* and the second housing 11*b*, but could be disposed closer to one or the other of the housings, as desired. Moreover, the first branch 11*c* and the second branch 11*d* are elongating in generally a straight line, but could be disposed at an angle with respect to one another, if desired.

As shown in FIG. 5 for example, the main body 11 desirably is formed of a single unitary forging that is molded with the desired exterior dimensions and that is drilled to provide the desired interior dimensions. In this way, the user need not connect the first branch 11*c* to the first housing 11*a* and to the central receptacle 11*g*. Nor does the user need to connect the second branch 11*d* to the second housing 11*b* and to the central receptacle 11*g*. In forming the main body 11 as a unitary structure, this extra assembly is avoided and the installation process is simplified. Moreover, forming the main body 11 as a unitary structure avoids four possible interfaces where connections otherwise would need to be made. Thus, leaks at these four connections are avoided. Leaks are thereby avoided between the first branch 11*c* and each of the first housing 11*a* and the central receptacle 11*g*, and similarly between the second branch 11*d* and each of the second housing 11*b* and the central receptacle 11*g*.

As shown in FIG. 1, a first set screw 28*a* is configured to be threaded into a threaded opening defined through the first housing 11*a*. Similarly, a second set screw 28*b* is configured to be threaded into an opening defined through the second housing 11*b*. The set screws 28*a*, 28*b* seal off the holes that were used to drill through the forging that desirably is used to make the main body 11, respectively, the first passage 11*e* in the first branch 11*c* and the second passage 11*f* in the second branch 11*d*.

As shown in FIG. 1, the central receptacle 11*g* defines an upper projection 11*h* that is cylindrical and desirably defines an external surface 111 having a plurality of screw threads thereon. As shown in FIG. 5, the central receptacle 11*g* further defines a lower projection 11*j* that is cylindrical and desirably defines an internally threaded surface 11*k*. As shown in FIG. 5, the central receptacle 11*g* with its upper projection 11*h* and lower projection 11*j* define internally thereof a central channel 111. In an alternative embodiment, the central channel 111 is open only on the end defined by the upper projection 11*h* and is sealed at the end defined by the lower projection 11*j*. However, in the embodiment shown in FIG. 5 for example, it is possible to provide via the internally threaded surface 11*k* a threaded connection to the end of central channel 111 that is defined by the lower projection 11*j*. Thus, it is possible to screw in a simple plug via the internally threaded surface 11*k* or connect a conduit that can supply liquid to or drain off liquid from the central receptacle 11*g*.

The faucet 10 is provided with the hot and cold valves already assembled and tested at the factory and held in a pair of valve housings that are connected to the first and second housings 11*a*, 11*b* of the main body 11. Each of the first housing 11*a* and the second housing 11*b* is configured to contain at least part of a valve that includes both a valve cartridge and a valve cartridge seat. As shown in FIG. 1 for example, a first valve housing includes a first threaded sleeve 12*a* that is configured to be connected at one end thereof to the first housing 11*a*. Similarly, a second valve housing includes a second threaded sleeve 12*b* that is configured to be connected at one end thereof to the second housing 11*b*. Each first sleeve 12*a* and second sleeve 12*b* is desirably cylindrical in shape and configured to receive internally therein a respective first and second valve cartridge. As shown in FIG. 5 for example, the interior surface of the bottom end of the first threaded sleeve 12*a* is defined by a screw threaded surface 12*c* that selectively permits detachable screwing attachment of the first sleeve 12*a* to the first housing 11*a* via the externally threaded surface 11*m* of the upwardly projecting portion of the first housing 11*a*. Similarly, as shown in FIG. 5 for example, the interior surface of the bottom end of the second threaded sleeve 12*b* is defined by a screw threaded surface 12*d* that selectively permits detachable screwing attachment of the second sleeve 12*b* to the second housing 11*b* via the externally threaded surface 11*n* of the upwardly projecting portion of the second housing 11*b*.

Desirably, each of the first and second threaded sleeves 12*a*, 12*b* is permanently connected at the factory in watertight fashion to its respective first housing 11*a* and second housing 11*b*. In an alternative embodiment, the first housing 11*a* and the first sleeve 12*a* can be provided as a unitary structure that avoids the need for the connection via the screwing engagement of the externally threaded surface 11*m* to the interior threaded surface 12*c* of the first sleeve 12*a*. A similar unitary structural arrangement can be implemented for the second housing 11*b* and the second sleeve 12*b*.

As shown in FIG. 1 for example, the exterior surface of the first sleeve 12*a* is desirably characterized by three different sections, a lower section, an intermediate section and an upper section. The lower section is defined by a threaded exterior surface 12*e*, and of the three sections the lower section has the largest external diameter and the longest axial length. The intermediate section 12*f* is the section having the smallest axial length and is also the section with the smallest external diameter and has a smooth external surface without any threaded portion. The upper section has a threaded external surface 12*g* and has an external diameter intermediate the external diameter of the intermediate section 12*f* and the external diameter of the lower section 12*e*. Moreover, the leading edge of the radially extending threads of the upper section 12*g* defines a slight lip above the intermediate section 12*f*.

As shown in FIG. 1, a first extended bonnet 17*a* is provided and configured with an annular skirt 17*c* disposed adjacent and connected to a section that is configured so as to easily be engaged by a wrench or another tool for effecting rotation of the extended bonnet 17*a*. In the embodiment shown in FIG. 1, this easily engageable surface desirably has a configuration that includes a plurality of flat faces 17*d* and forms a unitary structure with the annular skirt 17*c*. As shown in FIG. 5, the interior surface 17*e* of the skirt 17*c* of the first extended bonnet 17*a* is defined by screw threads that are configured to be screwed onto the threaded exterior surface 12*g* (FIG. 1) of the upper section of the first sleeve 12*a*.

As shown in FIG. 1, the first extended bonnet 17*a* further defines internally thereof a threaded surface 17*f* that is configured to engage an exterior threaded surface 18*c* of a first packing nut 18*a*. A first lock nut 19*a* is configured to be screwed onto the threaded exterior surface 18*c* of the first packing nut 18*a*. As shown in FIG. 5, the first packing nut 18*a* has a distal end 18*d* that compresses a first sealing gasket 20*a* against an internal annular ledge 17*g* defined in generally the intermediate portion of the first extended bonnet 17*a*. As shown in FIG. 5 for example, the spindle 14*c* of the valve stem of a first valve cartridge 14*a* (FIG. 1) extends through a central opening that is defined through each of the first extended bonnet 17*a*, the first sealing gasket 20*a*, and the first packing nut 18*a*.

As shown in FIG. 1, a second extended bonnet 17*b*, a second packing nut 18*b*, a second lock nut 19*b* and a second sealing gasket 20*b* are desirably provided and configured identically, respectively, to the first extended bonnet 17*a*, the first packing nut 18*a*, the first lock nut 19*a*, and the first sealing gasket 20*a*, but for engagement with the second threaded sleeve 12*b*.

As shown in FIG. 1 for example, a first valve cartridge seat 13*a* and a first valve cartridge 14*a* are provided and are disposed within the first valve housing that includes the first housing 11*a* and the first sleeve 12*a*. This disposition of the first valve cartridge seat 13*a* and the first valve cartridge 14*a* is shown in relation to the sink deck 100 (indicated in chain-dashed outline) in a cross-sectional view in FIG. 5 for example.

Desirably, each of the first and second valve seats 13*a*, 13*b* is permanently connected at the factory in watertight fashion to its respective first housing 11*a* and second housing 11*b*. As shown in FIG. 1 for example, an annular flange 13*d* is disposed between the lower portion 13*c* and a connection portion 13*e* of the first valve seat 13*a*. The exterior surface of the connection portion 13*e* of the first valve seat 13*a* can be provided with a screw threaded surface. As shown in FIG. 5, the screw threaded surface of the connection portion 13*e* of the first valve seat 13*a* can be selectively connected to and screwed into an internally threaded surface 110 of the lower portion of the first housing 11*a*. A compressible O-ring 13*f* can be disposed between the flange and the end of the lower portion of the first housing 11*a* to provide a back-up or redundant seal water tight seal between the first valve cartridge seat 13*a* and the first housing 11*a*.

The lower end of the first valve seat 13*a* desirably is configured for selective attachment to a conduit leading from a source of water supply. In the embodiment shown, this selective attachment is facilitated by the provision of a screw threaded surface 13*c* formed in the exterior of the lower portion of the first valve seat 13*a*. Alternatively, a screw threaded portion can be provided on the interior surface of the lower portion of the first valve seat 13*a*. Additionally, some other means of selective attachment could be configured at the lower portion of the first valve seat 13*a*.

The particulars of the valve cartridge seat and the valve cartridge are not unique to the present invention and thus not described in greater detail. An example of a suitable valve cartridge 14*a* is disclosed in commonly owned U.S. Pat. No. 7,306,005, which is incorporated herein for all purposes by this reference. In the embodiment schematically shown in FIG. 1, the first valve cartridge 14*a* desirably can include components such as a first valve stem 14*c*, a first sealing gasket 14*d*, a first threaded bolt 14*e*, a first inner sleeve 14*f*, and a first inner washer 14*g*. As shown in FIG. 5, the exterior cylindrical surface of the free end of the spindle portion of the valve stem 14*c* can be provided with splines 14*h* that are configured to be non-rotatably received by a first valve handle 14*i* (FIG. 7D). The second valve cartridge 14*b* can be similarly configured, although the threads on the inner surface of the second inner sleeve will be pitched oppositely to the pitch on the threads of the first inner sleeve 14*f* so that the valves for hot and cold will turn in the conventional directions.

As shown in FIG. 1, a first threaded flange nut 15*a* desirably is provided and configured with a wide brim flange 15*c* on one end thereof and with an internally threaded surface 15*d* that is axially extending through the first threaded flange nut 15*a*. The first threaded flange nut 15*a* can be screwed onto the threaded exterior surface 12*e* on the lower section of the first threaded sleeve 12*a*. A second threaded flange nut 15*b* is provided and desirably configured identically to the first threaded flange nut 15*a* for purposes of being screwed onto the threaded exterior surface on the lower section of the second threaded sleeve 12*b*.

In an alternative embodiment, one or each of the first threaded flange nut 15*a* and the second threaded flange nut 15*b* can be replaced by two separate pieces, namely, a threaded nut and a washer. The washer can be configured to substitute for and function similarly as would the flange portion 15*c* of the first threaded flange nut 15*a* or the second threaded flange nut 15*b*. However, the presently preferred embodiment includes the first threaded flange nut 15*a* as a unitary structure and the second threaded flange nut 15*b* as a unitary structure, as they enable assembly to be performed in a slightly easier manner as only a single part must be manipulated rather than two separate parts.

A first C-washer 16*a* is provided and defines internally thereof a half groove that includes an internal ledge 16*c* that is configured to receive thereon a circumferential section of the shoulder that is defined in the exterior surface of the valve housing. As shown in FIG. 5, the shoulder 17*h* in the exterior surface of the valve housing is provided by the free edge 17*h* of the annular skirt 17*c* of the first extended bonnet 17*a* where it overlies the threaded external surface 12*g* of the upper section of the first threaded sleeve 12*a*. A second C-washer 16*b* is provided and desirably configured identically to the first C-washer 16*a* for purposes of engaging the shoulder of the valve housing that is provided by the free edge 17*h* of the annular skirt 17*c* of the second extended bonnet 17*b* where it overlies the threaded external surface 12*g* of the upper section of the second threaded sleeve 12*b*. As shown in FIGS. 7B and 7C, by inserting the C-washers 16*a*, 16*b* configured in this way, the C-washers 16*a*, 16*b* automatically level the faucet 10 with respect to the upper surface of the sink deck 100. This self-leveling feature eliminates numerous manufacturing concerns with tolerances of various parts and both speeds and simplifies the installation process.

As shown in FIG. 5 for example, an elongated hollow tubular member provides a center shank 23 that defines internally thereof a central passage 23*a* axially through the entire length of the center shank 23. The central passage 23*a* of the center shank 23 provides a path toward the gooseneck 31 shown in FIG. 7D for fluid entering the central channel 111 of the central receptacle 11*g* from the first passage 11*e* and the second passage 11*f* of the main body 11. As shown in FIG. 1 for example, one end of the center shank 23 defines a relatively smooth axially extending surface 23*b* around the circumference of the exterior of the center shank 23. The smooth surface 23*b* of the one end of the center shank 23 defines a relatively narrow exterior diameter. The remaining axially extending exterior surface of the center shank 23 is defined by a threaded surface 23*c* having a relatively larger exterior diameter.

As shown in FIG. 1, a compression nut 21 is provided with an exterior portion that is configured so as to easily be engaged by a wrench or another tool for effecting rotation of the compression nut 21. In the embodiment shown in FIG. 1, this configuration includes a plurality of flat side facets 21*a* that are configured to lend themselves for grasping by a wrench. One end of the compression nut 21 is defined by an annular collar 21*b* disposed around a central opening 21*c* that extends axially through the compression nut 21. As shown in FIG. 5 for example, the interior surface 21*d* of the faceted exterior portion of the compression nut 21 defines a screw thread that is configured to be screwed on the externally threaded surface 111 of the upper projection 11*h* of the central receptacle 11*g*.

Figure 6:
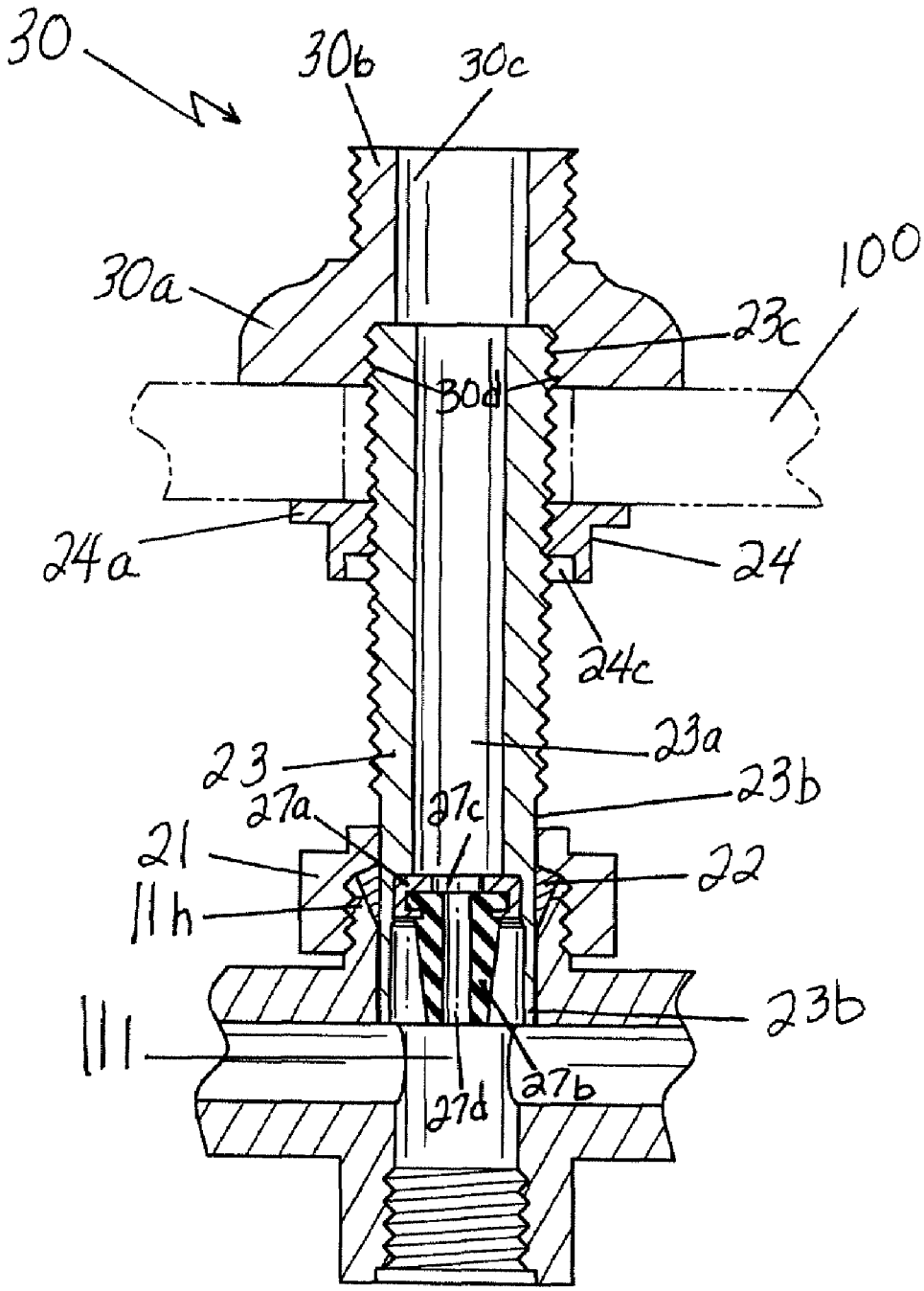
FIG. 6 is cross-sectional view of an alternative embodiment of the center shank assembly shown in FIG. 2.

As shown in FIG. 6 for example, a compression fitting 22 is disposed within the end 23*b* of the center shank 23 fitted into the portion of the central channel 111 defined by the upper projection 11*h* of the central receptacle 11*g*. The internal central opening 21*c* of the collar 21*b* of the compression nut 21 shown in FIG. 1 is configured to slideably receive therein the narrow exterior diameter end 23*b* of the center shank 23 that defines internally thereof the central passage 23*a* axially through the center shank 23. As shown in FIG. 6 for example, the compression fitting 22 is disposed between the internal cavity of the compression nut 21, the exterior surface 23*b* of the center shank 23 and the interior surface of the upper projection 11*h*. Upon tightening of the compression nut 21 onto the externally threaded surface 111 of the upper projection 11*h* of the central receptacle 11*g*, the compression fitting 22 is squeezed and compressed to provide a watertight seal of the center shank 23 to the main body 11.

A flow control device desirably is incorporated in the center shank 23. As shown in FIG. 1 for example, a flow control device desirably includes a flow tower 27 that desirably includes a rigid flow fitting 27*a* configured to receive and hold therein an elongated gasket 27*b*. As shown in FIG. 6 for example, the exterior surface of the flow fitting 27*a* is received within an annular bore that is defined in the internal surface of the end 23*b* of the central shank 23 that is to be compression fitted to the main body 11. As shown in FIG. 6 for example, the flow fitting 27*a* and gasket 27*b* of the flow tower desirably is press-fit into the end 23*b* of the center shank 23 that is sealed water-tight by compression fitting 22 to the main body 11. The rigid flow fitting 27*a* of the flow tower 27 defines a central opening 27*c* axially through the rigid flow fitting 27*a*. The elongated gasket 27*b* defines axially therethrough a central channel 27*d* having a diameter that is less than the diameter of the central opening 27*c* of the flow fitting 27*a* but desirably is concentrically aligned therewith.

As shown in FIG. 6 for example, the inlet of the central channel 27*d* is disposed in communication with the first passage 11*e* and with the second passage 11*f* of the main body 11 via the central channel 111 of the central receptacle 11*g*. The exterior surface of the elongated gasket 27*b* desirably is conically shaped and tapers as one moves away from where the elongated gasket 27*b* is attached to the flow fitting 27*a*. The elongated gasket 27*b* can provide the faucet 10 with a channel that has a diameter that is configured and sized to provide the desired maximum flow through the central passage 23*a* of the center shank 23. The elongated gasket 27*b* desirably is formed of rubber or other compressible material that can be squeezed and fitted into the space provided therefor by the configuration of the flow fitting 27*a*. To change the maximum flow permitted through the central passage 23*a* of the center shank 23, one must change the center shank 23 to one provided with a press-fit flow control device 27 having a different flow rating. Thus, neither replacement of either valve cartridge 14*a*, 14*b* or the gooseneck 31 will affect the maximum flow permitted through the central passage 23*a* of the center shank 23 and out of the gooseneck 31.

As shown in FIG. 1 for example, a central threaded flange nut 24 is provided with an annular flange 24*a* at one end thereof. As shown in FIG. 1 for example, the central threaded flange nut 24 is provided with a threaded interior opening 24*b* therethrough that is configured to be screwed onto the threaded larger diameter surface 23*c* of center shank 23. As shown in FIGS. 5 and 6 for example, the central threaded flange nut 24 is provided with an annular-shaped, recess 24*c* in the opposite end thereof and surrounding the interior opening 24*b*. The exterior diameter of the collar 21*b* of the compression nut 21 is sufficiently smaller than the interior diameter of the annular-shaped, recess 24*c* of the central flange nut 24 so that the collar 21*b* can be received therein and nest within the recess 24*c* while the threaded flange nut 24 is carried atop the compression nut 21 during the beginning of the process of installing the faucet 10 in the sink deck 100. As shown in phantom in dashed line in FIG. 4 for example, the outline of the collar 21*b* of the compression nut 21 is shown nesting within the annular-shaped recess of the central flange nut 24. The same arrangement would exist if the combination of the threaded nut 26 and washer 25 were resting atop the compression nut 21.

Figure 1A:
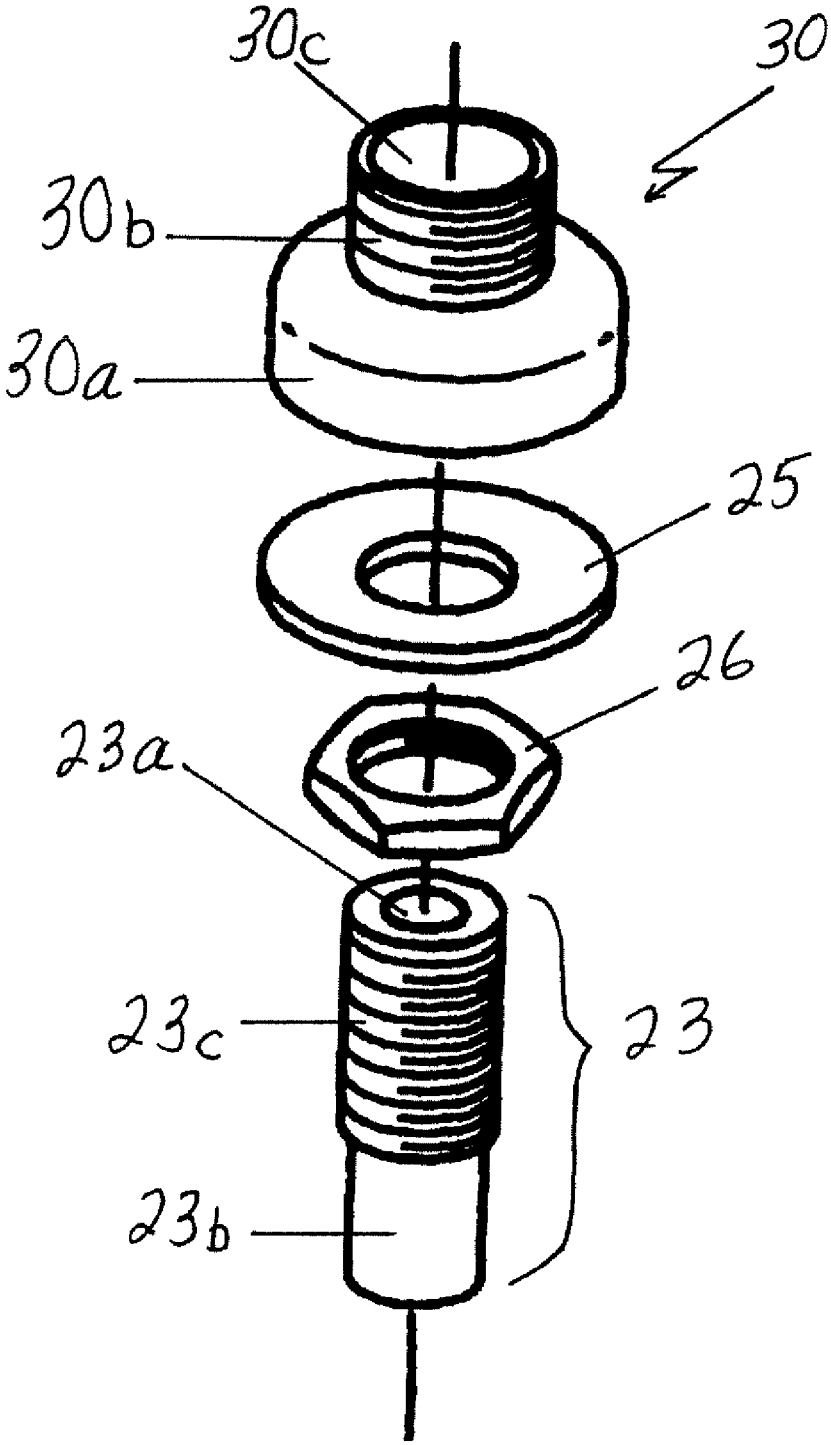
FIG. 1A is an elevated perspective, assembly view of an alternative embodiment of components of the faucet assembly of the present invention.

In an alternative embodiment shown in FIG. 1A for example, a separate flat washer 25 and a separate threaded nut 26 can be substituted for the central threaded flange nut 24 shown in FIG. 1. In this alternative embodiment shown in FIG. 1A, the threaded nut 26 is desirably provided with a recess similar to the recess 24*c* in the threaded flange nut 24 shown in FIG. 1. The collar 21*b* of the compression nut 21 would be received in and nest within the recess within the threaded nut 26 while the threaded nut 24 was carried atop the compression nut 21 during the beginning of the process of installing the faucet 10 in the sink deck 100.

As shown in FIGS. 1 and 1A for example, a deck flange 30 is provided with a skirt portion 30*a* on one end and a cylindrical portion 30*b* on the opposite end. A central conduit 30*c* is provided axially through the deck flange 30. The diameter of the central conduit 30*c* desirably is larger than the diameter of the central passage 23*a* of the center shank 23. As shown in FIGS. 1 and 1A for example, the skirt 30*a* defines internally thereof a threaded surface 30*d* that is configured to engage the threaded larger diameter exterior surface 23*c* of the center shank 23 and can be removably screwed onto surface 23*c* of the center shank 23. The exterior surface of the cylindrical end 30*b* of the deck flange 30 is provided with a threaded surface that is configured to be threadedly connected to a complimentarily threaded surface of a gooseneck 31 (FIG. 7D).

Figure 4:
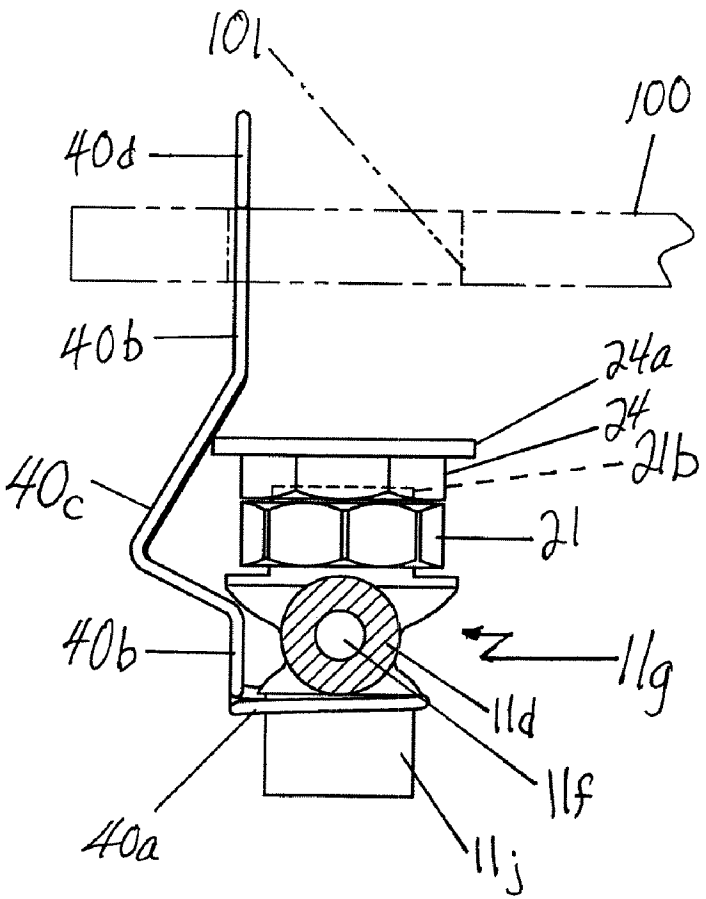
FIG. 4 is side plan view of an embodiment of the center shank assembly taken in the direction in which the arrows designated 4-4 in FIG. 7B are pointing.
Figure 3:
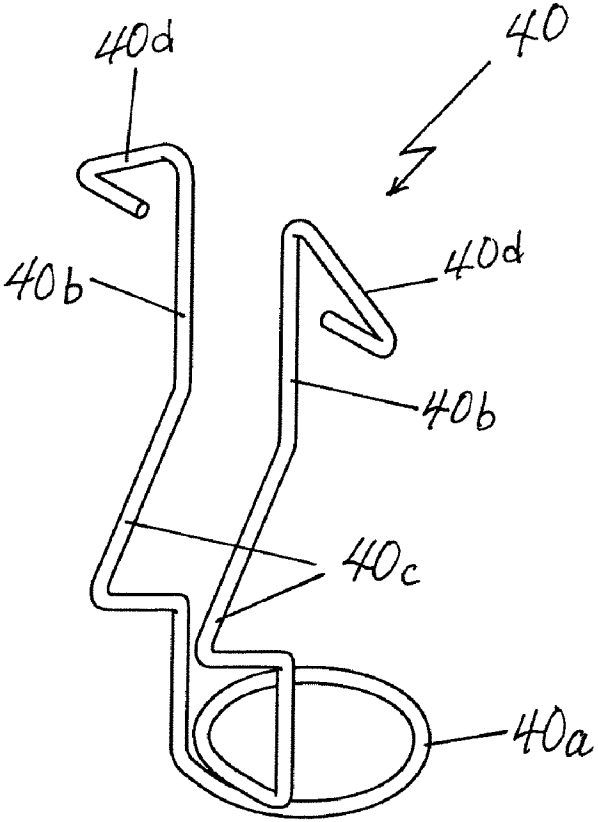
FIG. 3 is an elevated perspective view of an embodiment of a hanger that can be used during installation of the faucet assembly of the present invention.

As shown in FIGS. 1 and 3 for example, a bent wire hanger 40 is provided and defines a ringed opening 40*a* at one end thereof. As shown in FIG. 4 for example, the ringed opening 40*a* desirably is configured to receive therethrough the exterior surface of the central receptacle 11*g* of the main body 11. The wire hanger 40 further is configured with a pair of parallel legs 40*b* that extend generally at a right angle to the plane defined by the ringed opening 40*a*. As shown in FIG. 4 for example, each of the legs 40*b* is provided with a triangular recess 40*c* that is configured to accommodate the compression nut 21 and the annular flange 24*a* of the central threaded flange nut 24 and/or the combination of the threaded nut 26 and washer 25 resting atop the compression nut 21. As shown in FIG. 3 for example, on the end of each of the legs 40*b* of the hanger 40 opposite the end extending from the ringed opening 40*a* is defined an outwardly extending arm 40*d*. As shown in FIG. 4 for example, each arm 40*d* can be rested atop the sink deck 100 when the axially extending leg of the hanger 40 is projecting through a central opening 101 defined through the sink deck 100.

A method of installing in the deck 100 of a sink, the concealed, widespread faucet 10 in accordance with an embodiment of the present invention now will be described. It is assumed that the deck 100 of the sink has been prepared with three properly spaced and sized openings, including a central opening 101 flanked on each side by an outlying opening 102. The widespread faucet 10 is provided to the installer in the condition shown in FIG. 7A, which is fully assembled except for the center shank 23 and the deck flange 30, which is a component that is detachably connected to the center shank 23 but provided in the connected condition from the factory. At the factory, the respective valve cartridges 14*a*, 14*b* and valve seats 13*a*, 13*b* are installed and connected into the main body 11 with the respective sleeves 12*a*, 12*b* and valve seats 13*a*, 13*b* permanently lock-tightened to the main body as shown in FIG. 5 for example. At the factory, the respective extended bonnets 17*a*, 17*b*, which are part of the valve housings, are connected to the respective sleeves 12*a*, 12*b*, which are connected to the respective housings 11*a*, 11*b* of the main body 11 as shown in FIG. 5 for example. The respective sealing gaskets 20*a*, 20*b*, back-up compressible O-rings 13*f*, packing nuts 18*a*, 18*b* and lock nuts 19*a*, 19*b* also are installed at the factory where the valves also will have been leak tested prior to being shipped to a buyer.

The installer engages the wire hanger 40 with the central receptacle 11*g* of the main body 11 resting within the ringed opening 40*a* of the hanger 40 as shown in FIG. 4 so that the main body can be carried by the hanger 40. The installer rests the central threaded flange nut 24 on the compression nut 21 with the recess 24*c* receiving the collar 21*b* of the compression nut 21 so that the central threaded flange nut 24 is carried by the compression nut 21 in the manner shown in FIG. 4 for example.

Figure 7A:
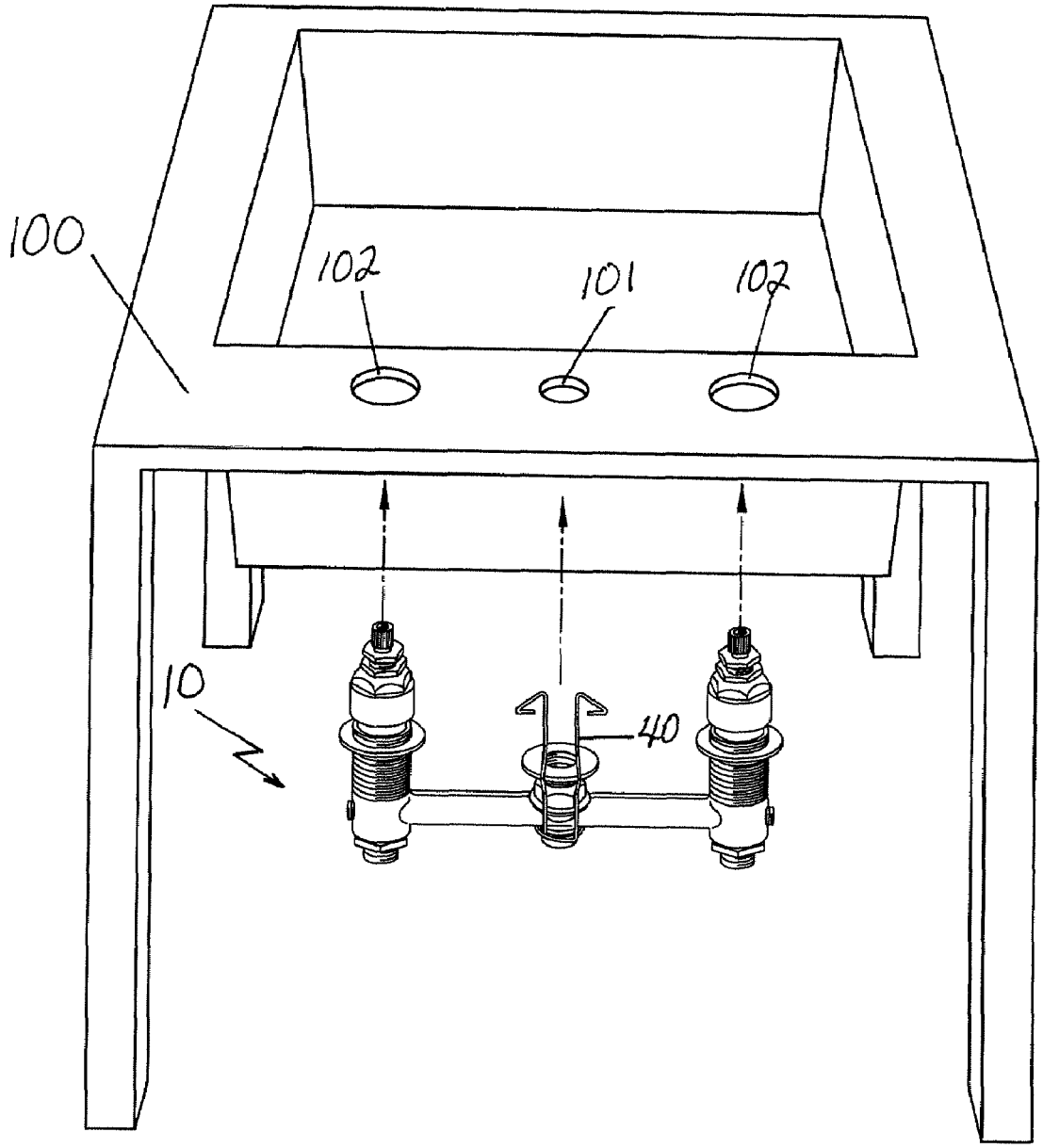
FIG. 7A is an elevated perspective view that schematically demonstrates part of the installation sequence of the faucet assembly in relation to a sink.
Figure 7B:
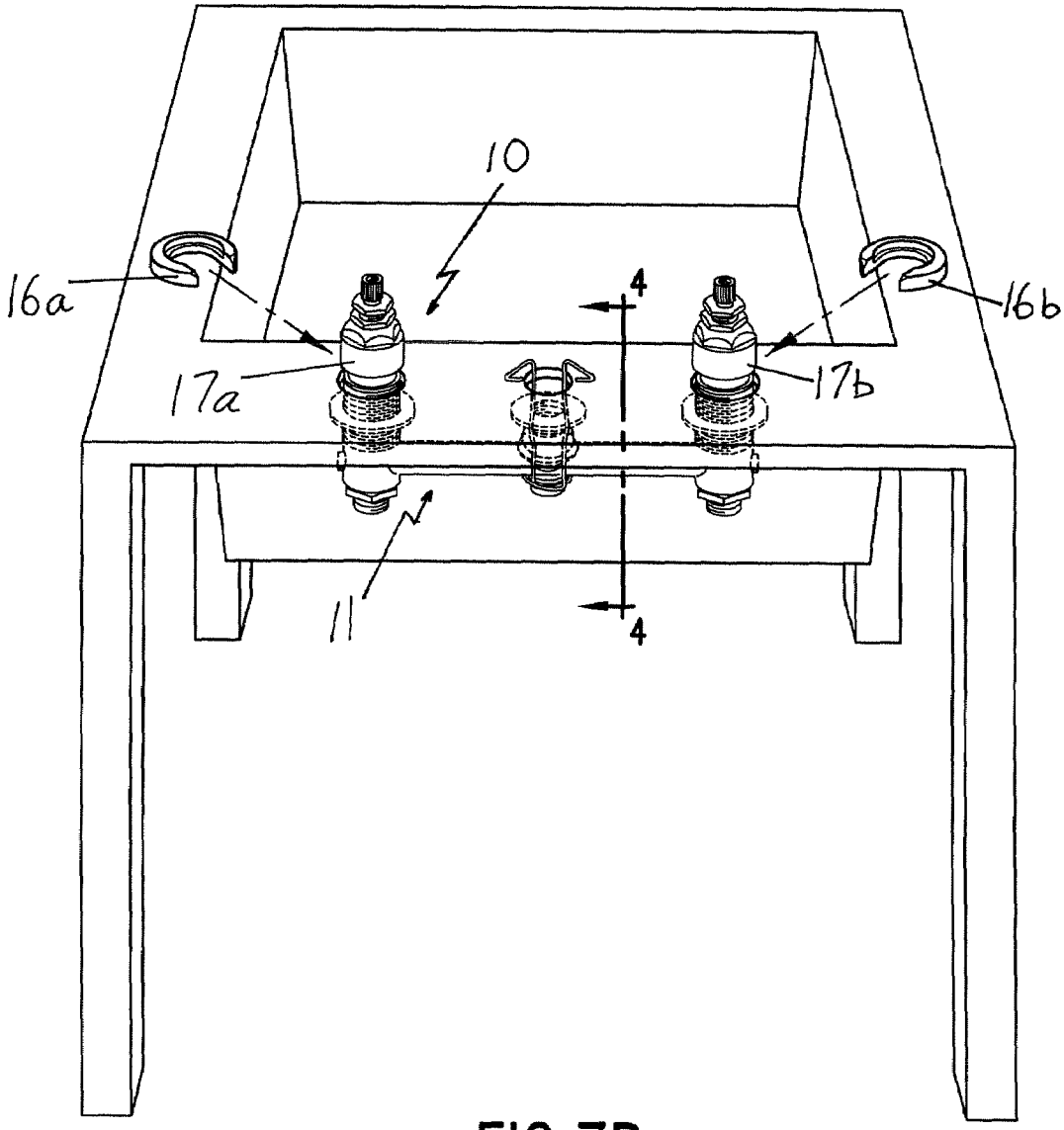
FIG. 7B is an elevated perspective view that schematically demonstrates part of the installation sequence of the faucet assembly in relation to a sink.
Figure 7C:
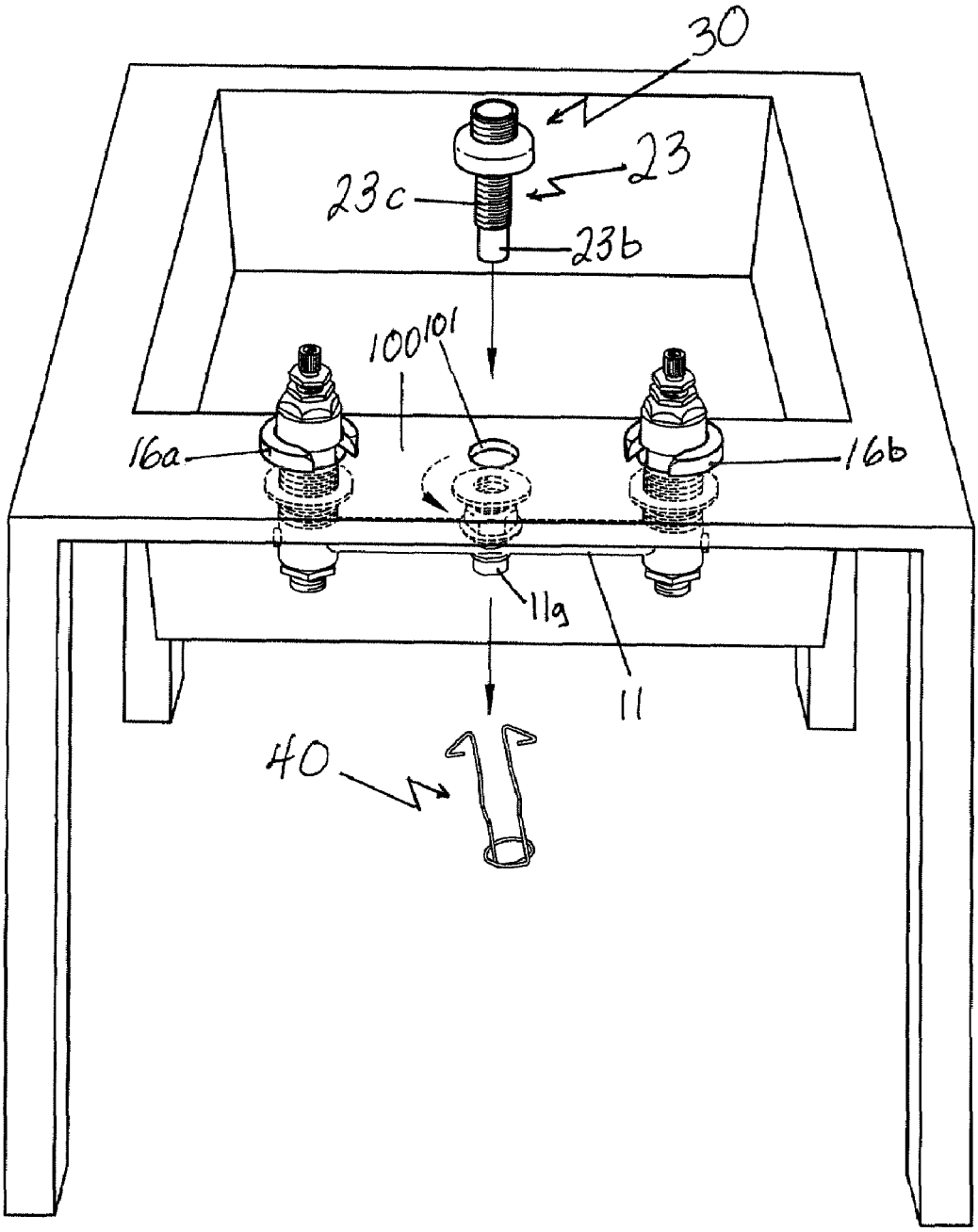
FIG. 7C is an elevated perspective view that schematically demonstrates part of the installation sequence of the faucet assembly in relation to a sink.
Figure 7D:
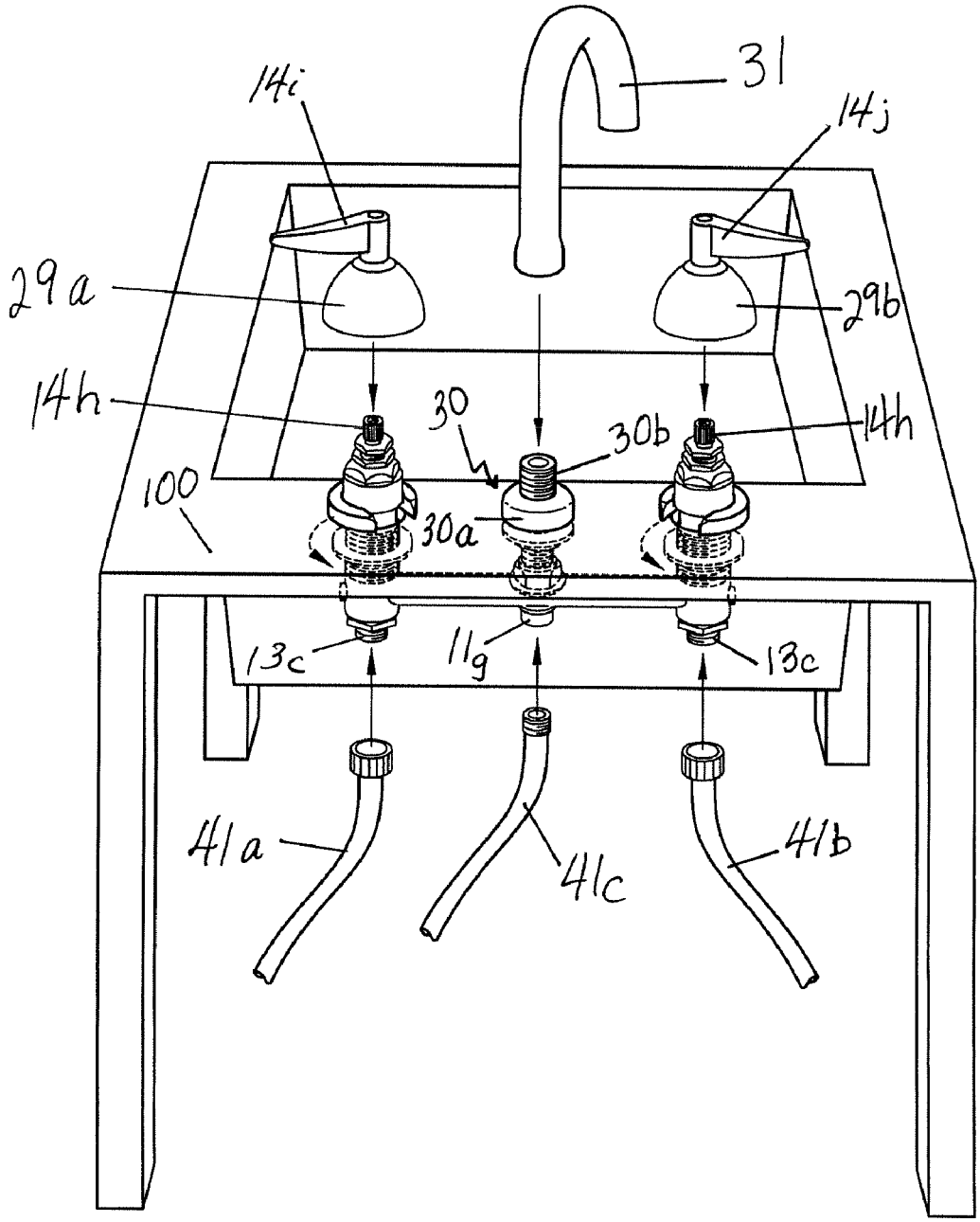
FIG. 7D is an elevated perspective view that schematically demonstrates part of the installation sequence of the faucet assembly in relation to a sink.

In this condition shown in FIG. 7A, the installer moves the faucet 10 into the openings 101, 102 in the sink deck 100. Each of the valve housings is inserted through one of the flanking openings 102. The triangular shape of the arms 40*d* easily permit the arms 40*d* to pass through the central opening 101 in the sink deck 100. The triangular shape of the arms 40*d* of the hanger 40 ensure that the legs 40*b* of the hanger 40 are squeezed together as the arms 40*d* are pushed through the central opening 101 by the installer. At the conclusion of this step, the faucet 10 and hanger 40 are disposed as shown in FIGS. 7B and 4.

The installer then inserts a first C-washer 16*a* under the shoulder formed in one of the valve housings and a second C-washer 16*b* under the shoulder formed in the other valve housing. As shown in FIG. 5 for example, the shoulder 17*h* formed at the free end of the first extended bonnet 17*a* of one valve housing is received in and carried by the internal ledge 16*c* (FIG. 1) of the first C-washer 16*a*. Similarly, the second C-washer 16*b* is inserted so as to receive in its internal ledge 16*c* (FIG. 1) the shoulder 17*h* formed by the free end of the second extended bonnet 17*b* of the second valve housing. The C-washers 16*a*, 16*b* automatically level the faucet 10 with respect to the upper surface of the sink deck 100. Once the C-washer 16*a*, 16*b* are in place, each of the first and second threaded flange nuts 15*a*, 15*b* is rotated on the respective threaded exterior surfaces 12*e* of the lower section of each of the respective first and second threaded sleeves 12*a*, 12*b*. The first and second threaded flange nuts 15*a*, 15*b* are rotated until the upper surface of the rim flanges 15*c* are resting securely against the underside of the sink deck 100 as shown in FIG. 5 for example.

Then, as shown in FIG. 7C, the installer squeezes the arms 40*b* of the hanger 40 together and pushes the arms 40*d* downwardly through the central opening 101 of the sink deck 100 until the hanger 40 disengages from the sink deck 100 and from the central receptacle 11*g* of the main body 11. This condition is shown in FIG. 7C as the hanger 40 is falling in the direction of the arrow disposed just above hanger 40 in FIG. 7C.

Once the central opening 101 in the sink deck 100 is vacant, the installer can insert from above the deck 100, the center shank 23 with the deck flange 30, which has been tightened and sealed at the factory onto the free end of the threaded exterior surface 23*c* of the center shank 23. Because this can be done under factory conditions, the seal is more reliable and installation time is reduced. The installer inserts the center shank 23 through the central opening 101 until the free end of the center shank 23 with the smooth exterior surface 23*b* is inserted into the upper projection 11*h* of the central receptacle 11*g*. The installer then secures the center shank 23 to the main body 11 by tightening the compression nut 21 onto the upper projection 11*h* of the central receptacle 11*g* of the main body 11. As shown in FIG. 6 for example, tightening the compression nut 21 that is on the center shank 23 beneath the sink deck 100 automatically seals the center shank 23 against the compression fitting 22. Once the compression nut 21 has been tightened onto the main body 11, the center shank 23 is connected in water-tight fashion to the main body 11 of the faucet 10.

The compression fitted center shank 23 allows for tolerance stacking caused by variations in material manufacturing and sink levelness. The compression fitted center shank 23 accomplishes this advantage automatically without any necessary adjustments needed from the installer.

Figure 2:
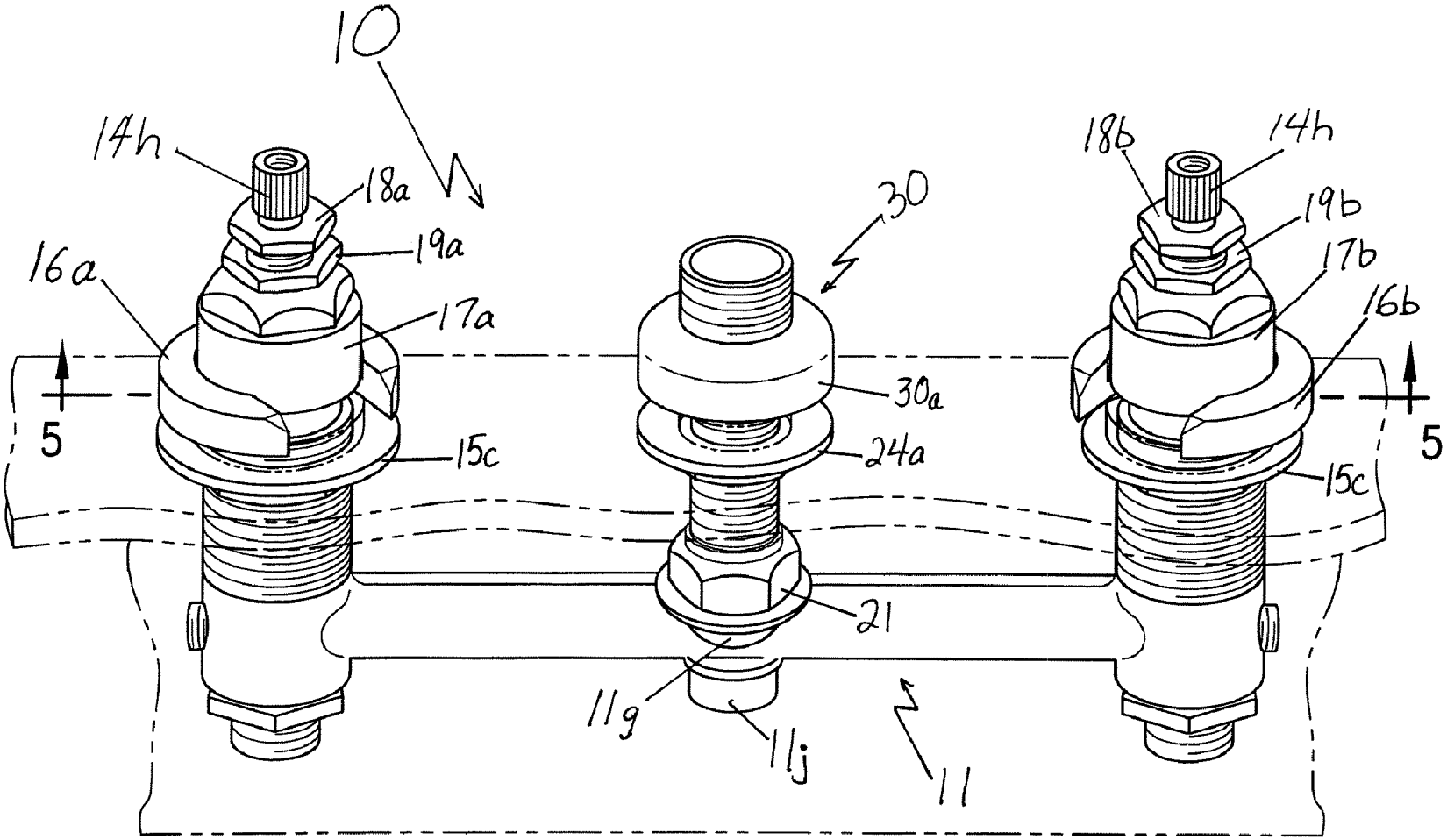
FIG. 2 is an elevated perspective view of the embodiment of the faucet assembly of FIG. 1 shown in an assembled stated with the relevant section of a sink indicated by chain-dashed line.

The installer then rests the skirt portion 30*a* of the deck flange 30 securely against the upper surface of the sink deck 100 as shown in FIGS. 2, 5 and 7D for example. Then the installer rotates the central threaded flange nut 24 until the annular flange 24*a* rests against the underside of the sink deck 100 as shown in FIGS. 5 and 6 for example. Then the installer tightens the compression nut 21 to seal the center shank 23 into the central receptacle 11*g* of the main body 11.

In summary, beneath the sink deck 100, the installer will need to tighten with a wrench or similar tool, in the following order, the two threaded flange nuts 15*a*, 15*b*, followed by the central threaded flange nut 24 and then the compression nut 21. The two threaded flange nuts 15*a*, 15*b* and the central threaded flange nut 24 are the three nuts 15*a*, 15*b* and 24 disposed against the underside of the sink deck 100. The one compression nut 21 is also disposed beneath the sink deck 100 but only connects the center shank 23 to the main body 11.

At this point, the wide spread faucet 10 is installed to the sink deck 100 as shown in FIGS. 2 and 7D for example. The main body 11 is concealed beneath the sink deck 100, which is secured to one of the valve housings by being held between a brim flange 15*c* and the first C-washer 16*a*. Similarly, the sink deck 100 is secured to the other one of the valve housings by being held between a brim flange 15*c* and the second C-washer 16*b*. Likewise, the sink deck 100 is secured to the center shank 23 by being held between an annular flange 24*a* (or washer 25 and nut 26) and the skirt portion 30*a* of the deck flange 30.

As shown in FIG. 7D, the installer can connect the aesthetically pleasing components, which include escutcheons 29*a*, 29*b* to cover the portions of the valve housings that are exposed above the upper surface of the sink deck 100. The installer can attach each handle 14*i*, 14*j* to the splines 14*h* at the free end of each valve stem of each valve cartridge. One end of a gooseneck 31 can be connected to the cylindrical end 30*b* of the deck flange 30.

Beneath the sink deck 100, the installer can connect the appropriate water supply conduit 41*a*, 41*b* to one of the screw threaded surfaces 13*c* at the lower end of each valve seat 13*a*, 13*b*. Optionally, the installer can connect a third supply conduit 41*c* to the central receptacle 1*g*. Such a third supply conduit 41*c* optionally can be used for a side spray as one would find in a typical kitchen sink or to supply a pedal valve as one would find in a doctor's scrub room to enable the doctor to operate the sink's water supply using a foot instead of the doctor's hands.

The time to install this widespread faucet 10 is about 3 minutes or less for the plumber, and can be installed by less skilled labor such as the plumber's helper in the same amount of time. The widespread faucet 10 is pre-assembled at the factory, self leveling and has fewer nuts to tighten than conventional sinks.

While at least one presently preferred embodiment of the invention has been described using specific terms, such description is for illustrative purposes only, and it is to be understood that changes and variations may be made without departing from the spirit or scope of the following claims.

What is claimed is:

1. A concealed, wide spread faucet for installation in a sink, comprising:

a main body, said main body defining a first housing configured for carrying a first valve housing, said main body defining a second housing configured for carrying a second valve housing, said main body defining a receptacle for receiving a center shank, said receptacle being disposed between said first and second housings, said main body defining a hollow first branch disposed between said first housing and said receptacle, said main body defining a hollow second branch disposed between said second housing and said receptacle;

a first valve housing having one end connected to said first housing and defining a first shoulder in a first exterior surface of said first valve housing, a second valve housing having one end connected to said second housing and defining a second shoulder in a first exterior surface of said second valve housing;

a first valve cartridge held in said first valve housing;

a second valve cartridge held in said second valve housing;

a first annular flange defining a central opening receiving a portion of said first exterior surface of said first valve housing;

a first nut engaging said first valve housing and carrying said first annular flange;

a first C-washer engaging said first shoulder of said first valve housing;

a second annular flange defining a central opening receiving a portion of said first exterior surface of said second valve housing;

a second nut engaging said second valve housing and carrying said second annular flange;

a second C-washer engaging said second shoulder of said second valve housing;

a hollow center shank having a first end and a second end opposite said first end, said first end of said center shank being connected to said receptacle of said main body;

a center annular flange defining a central opening receiving said first end of said center shank;

a center nut engaging said center shank and carrying said center annular flange; and a deck flange defining a central opening receiving the second end of said center shank, said center annular flange being disposed between said center nut and said deck flange.

2. A concealed, wide spread faucet as in claim 1, wherein said first valve housing includes a first sleeve having one end detachably connected to said first housing.

3. A concealed, wide spread faucet as in claim 1, further comprising a compression nut connecting said center shank to said receptacle of said main body.

4. A concealed, wide spread faucet as in claim 1, wherein said main body defines a unitary structure.

5. A concealed, wide spread faucet as in claim 1, further comprising a flow control device disposed within the receptacle of the main body.

6. A concealed, wide spread faucet as in claim 1, further comprising a flow control device disposed within the center shank.

7. A concealed, wide spread faucet as in claim 1, wherein said first housing carries a first valve cartridge seat.

8. A concealed, wide spread faucet as in claim 1, wherein said second housing carries a second valve cartridge seat.

9. A concealed, wide spread faucet as in claim 1, wherein said first nut and said first annular flange form a unitary structure that is a first threaded flange nut.

10. A concealed, wide spread faucet as in claim 1, wherein said second nut and said second annular flange form a unitary structure that is a second threaded flange nut.

11. A concealed, wide spread faucet as in claim 1, wherein said center nut and said center annular flange form a unitary structure that is a central threaded flange nut.

12. A concealed, wide spread faucet for installation in a sink, comprising:

a main body, said main body defining a first housing configured for carrying a first valve housing, said main body defining a second housing configured for carrying a second valve housing, said main body defining a receptacle for receiving a center shank, said receptacle being disposed between said first and second housings, said main body defining a hollow first branch disposed between said first housing and said receptacle, said main body defining a hollow second branch disposed between said second housing and said receptacle;

a first valve housing having one end connected to said first housing and defining a first shoulder in a first exterior surface of said first valve housing;

wherein said first valve housing includes a first threaded sleeve having an annular groove disposed between a threaded exterior surface of a relatively larger diameter and a threaded exterior surface of a relatively smaller diameter, said first threaded sleeve defining an internally threaded end disposed closer to said relatively larger diameter threaded exterior surface than said relatively smaller diameter threaded exterior surface, said internally threaded end threadedly engaging said externally threaded end of said first housing;

a second valve housing having one end connected to said second housing and defining a second shoulder in a first exterior surface of said second valve housing;

wherein said second valve housing includes a second threaded sleeve having an annular groove disposed between a threaded exterior surface of a relatively larger diameter and a threaded exterior surface of a relatively smaller diameter, said second threaded sleeve defining an internally threaded end disposed closer to said relatively larger diameter threaded exterior surface than said relatively smaller diameter threaded exterior surface, said internally threaded end threadedly engaging said externally threaded end of said second housing;

a first valve cartridge held in said first valve housing;

a second valve cartridge held in said second valve housing;

a first annular flange defining a central opening receiving said relatively larger diameter threaded exterior surface of said first threaded sleeve;

a first threaded nut threaded on said relatively larger diameter threaded exterior surface of said first threaded sleeve and carrying said first annular flange;

a first C-washer engaging said first shoulder of said first valve housing;

a second annular flange defining a central opening receiving said relatively larger diameter threaded exterior surface of said second threaded sleeve;

a second threaded nut threaded on said relatively larger diameter threaded exterior surface of said second threaded sleeve and carrying said second annular flange;

a second C-washer engaging said second shoulder of said second valve housing;

a hollow center shank having a first end and a second end opposite said first end, said first end of said center shank being connected to said receptacle of said main body;

a center annular flange defining a central opening receiving said threaded exterior end of said center shank;

a center nut engaging said center shank and carrying said center annular flange;

a deck nut engaging said center shank; and a annular deck flange defining a central opening receiving the second end of said center shank, said annular flange being disposed between said deck nut and said annular deck flange.

13. A concealed, wide spread faucet as in claim 12, wherein said main body defines a unitary structure.

14. A method of installing a concealed, wide spread faucet in a sink deck defining three openings, the faucet including a main body, the main body defining a first housing connected to a first valve housing and containing a first valve cartridge and first valve seat, the main body defining a second housing connected to a second valve housing and containing a second valve cartridge and second valve seat, the main body defining a receptacle for receiving a center shank, the receptacle being disposed between the first and second housings, the main body defining a hollow first branch disposed between the first housing and the receptacle, the main body defining a hollow second branch disposed between the second housing and the receptacle, wherein the main body defines a unitary structure, the method comprising:

disposing the first valve housing through a first one of the openings in the deck from beneath the deck and disposing the second valve housing through a second one of the openings in the deck from beneath the deck;

using a hanger to hold the main body in position beneath the sink deck with the first valve housing projecting at least partially above the sink deck through the first one of the openings in the deck and the second valve housing projecting at least partially above the sink deck through the second one of the openings in the sink deck; and engaging each valve housing with a C-washer disposed above the deck of the sink to thereby set the height of each valve housing above the deck of the sink.

15. A method as in claim 14, further comprising:

securing each valve housing to the sink deck.

16. A method as in claim 14, further comprising:

inserting the center shank through a third one of the openings in the sink deck from above the sink deck and connecting the center shank to the sink deck with one end of the center shank projecting above the sink deck.

17. A method as in claim 16, further comprising:

connecting the other end of the center shank to the main body.

18. A method as in claim 14, wherein the hanger projects through a third one of the sink deck openings with one portion of the hanger engaging the main body and another portion of the hanger engaging the sink deck.

19. A method as in claim 18, wherein before inserting the center shank, disengaging the hanger from the main body and from the sink deck.

20. A method as in claim 14, wherein:

before connecting one end of the center shank to the sink deck, a center flange nut is carried by a compression nut while one end of the center shank is passed through a third one of the sink deck openings and into the main body after passing through the both the compression nut and the center flange nut.

* * * * *